US005592806A

United States Patent [19]

Berghmans et al.

[11] Patent Number: 5,592,806

[45] Date of Patent: Jan. 14, 1997

[54] NON-WRAPPED NON-SLEEVING COMPACT CORD

[75] Inventors: Joost Berghmans, Stevoort; Johan De Waegenaere, Zwevegem; Pierre Klingeleers, Maasmechelen; Frans Van Giel, Wevelgem, all of Belgium

[73] Assignee: N.V. Bekaert S.A., Zwevegem, Belgium

[21] Appl. No.: 603,385

[22] Filed: Feb. 20, 1996

Related U.S. Application Data

[63] Continuation of Ser. No. 233,506, Apr. 26, 1994, abandoned.

[30] Foreign Application Priority Data

Jun. 2, 1993 [EP] European Pat. Off. ..... 93201572

[51] Int. Cl.[6] ..... D02G 3/36

[52] U.S. Cl. ..... 57/212; 57/213; 57/217; 57/902

[58] Field of Search ..... 57/212, 213, 217, 57/902, 12, 13, 15, 58.52, 58.65, 314, 7, 295, 296

[56] References Cited

U.S. PATENT DOCUMENTS

| | | | |
|---|---|---|---|
| 1,993,110 | 3/1935 | Myers, Jr. | 57/7 X |
| 3,858,635 | 1/1975 | Nakamoto et al. | 57/902 X |
| 4,332,131 | 6/1982 | Palsky et al. | 57/213 |
| 4,488,587 | 12/1984 | Umezama et al. | 57/902 |
| 4,651,513 | 3/1987 | Dambre | 57/213 X |
| 4,707,975 | 11/1987 | Umezawa | 57/212 |
| 4,738,096 | 4/1988 | Hatakeyama et al. | 57/206 |
| 4,887,421 | 12/1989 | Haislet | 57/58.65 X |
| 4,947,636 | 8/1990 | Sinopoli | 57/212 X |
| 4,966,216 | 10/1990 | Kawasaki et al. | 57/902 X |
| 5,321,941 | 6/1994 | Bollen et al. | 57/213 |

FOREIGN PATENT DOCUMENTS 0143767 6/1985 European Pat. Off. .

OTHER PUBLICATIONS

Emsworth, "Process For The Manufacture Of A Strand, As Well As A Strand Made According To This Process, And Elastomer Or Synthetic Material Objects Reinforced With Such Strands", *Research Disclosure*, pp. 26–28, (1978).

*Primary Examiner*—William Stryjewski
*Attorney, Agent, or Firm*—Foley & Lardner

[57] ABSTRACT

A steel cord (10) adapted for the reinforcement of elastomeric articles including a center structure of one to five center filaments (16) and a maximum of two layers of layer filaments surrounding said center structure: an outer layer of outer layer filaments (12, 13) and optionally, an intermediate layer of intermediate layer filaments (24) between the center structure and the outer layer. All the center filaments (16) and all the layer filaments (12, 13, 24) have the same twist hand and have the same twist pitch. The outer layer filaments (12, 13) exert a force which is directed radially inward.

21 Claims, 2 Drawing Sheets

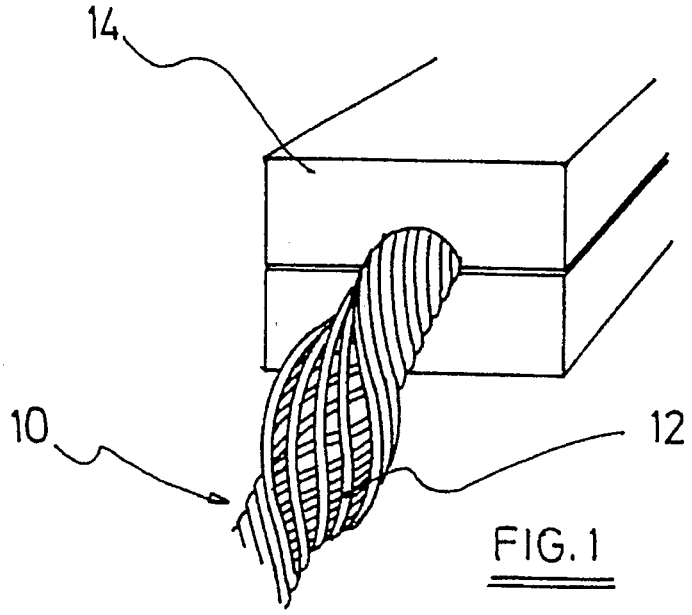
FIG. 1
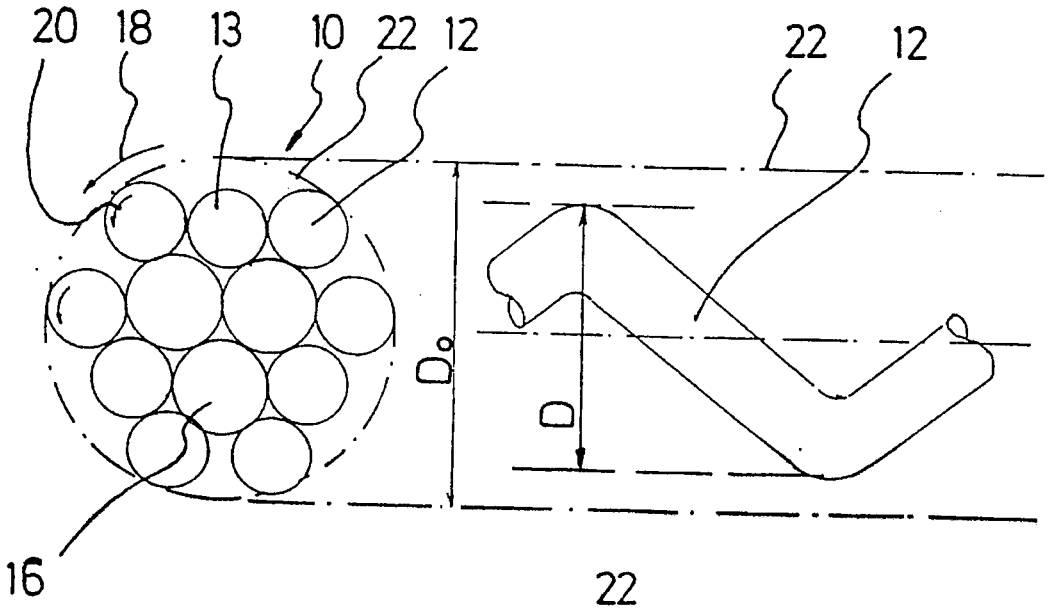
FIG. 2(a)
FIG. 2(b)

NON-WRAPPED NON-SLEEVING COMPACT CORD

This application is a continuation of application Ser. No. 08/233,506, filed Apr. 26, 1994, now abandoned.

FIELD OF THE INVENTION

The present invention relates to a steel cord adapted for the reinforcement of elastomeric articles such as the carcass plies and breaker plies of pneumatic radial tires, conveyor belts, hoses and timing belts.

BACKGROUND OF THE INVENTION

In the art of using steel cords, adapted to reinforce elastomeric articles, a general trend towards a simpler steel cord construction which can be manufactured in one single twisting step and consisting of fewer and fewer steel filaments has been recognised. Recently, in the art of reinforcing truck tires, there has been a trend toward using non-wrapped layered steel cord construction.

It is known that providing a layered steel cord construction with a wrapping filament that influences the properties and behaviour of steel cord construction, especially the stiffness and the elasticity.

Simply omitting the wrapping filament without amending the properties of the other steel filaments, constituting the steel cord, in order to fill in the demand for non-wrapped constructions can lead to a great many problems of processability. In particular, irregular spacing of the non-wrapped layered steel cord construction has been observed in the elastomeric plies.

SUMMARY OF THE INVENTION

It is an object of the present invention to reduce the problems of the prior art.

It is another object of the present invention to provide for a non-wrapped steel cord with good processability properties. It is further object of the present invention to provide for a non-wrapped steel cord which does not lead to irregular spacing in elastomeric plies.

According to the present invention, there is provided a steel cord adapted for the reinforcement of elastomeric articles. The steel cord comprises a center structure of one to five center filaments and a maximum of two layers of layer filaments surrounding said center structure: an outer layer of outer layer filaments and, optionally, one or more intermediate layers of intermediate layer filaments between the center structure and the outer layer. All the center filaments and all the layer filaments have the same twist hand and the same twist pitch. The outer layer filaments exert a force which is directed radially inward and which is of such a magnitude that sleeving of the steel cord is prevented.

A steel cord "adapted for use in the reinforcement of elastomeric articles" means that the steel cord has the necessary features to reinforce elastomeric articles. This means, either alone or in combination, that:

- the steel cord comprises steel filaments with a diameter ranging from 0.05 mm to 0.80 mm, and preferably from 0.05 mm to 0.45 mm;
- the steel filaments are coated with a layer that promotes adhesion to the elastomer; in the case of a rubber elastomer, copper alloy coatings such as brass (either low—63.5% Cu or high copper—67.5% Cu) or a complex brass coating (Ni+brass, brass+Co . . . ) having a thickness of 0.15 to 0.35 μm are particularly suitable;
- the steel filaments have a composition which is along the following lines: a carbon content ranging from 0.70 to 0.98%, a manganese content ranging from 0.10 to 1.10%, a silicon content ranging from 0.10 to 0.90%, sulphur and phosphorous contents limited to 0.15%, preferably to 0.010%; additional elements such as chromium (up to 0.20–0.40%), copper (up to 0.20%) and vanadium (up to 0.30%) may be added.

Layered steel cord construction where all the center filaments and all the layer filaments have the same twist hand and the same twist pitch are called compact cord constructions. The present inventors have discovered that the problem of spacing of the non-wrapped steel cords in the elastomeric plies is due to the outer layer Filaments being over length or due to insufficient tension in the outer layer filaments, the filaments in the cord no longer contact one another when drawn through an opening which is equal to the diameter of the steel cord (sleeving will be described in more detail with reference to the drawings). It is a fact that the wrapping filament of wrapped compact cord constructions compensates for a number of imperfections in the remaining cord. The wrapping filament, if put under sufficient tensile tensions, holds the cord tightly together. A non-wrapped cord which is fixed enough and tight enough to enable easy processing and to prevent sleeving can be obtained by having the outer layer filaments exerting a force which is directed radially inwards towards the center of the cord. In other words, the function of holding the cord fixed through the force once exerted by the wrapping filament, is now provided by the force exerted by the outer layer filaments.

Having the outer layer filaments exerting a force which is directed radially inward can be realized in three principal ways or in any combination of the three ways.

A first way to exert a force which is directed radially inward is to provide the outer layer filaments with residual torsions which tend to close the steel cord.

The "number of residual torsions" are herein defined as the number of revolutions one end of a specified length of cord or filament is allowed to turn freely.

In order to avoid sleeving of the cord, the degree of residual torsions of the outer layer filaments in the direction of closing of the cord is made as high as possible, nevertheless the degree of residual torsions of the outer filaments is limited in order to avoid other kinds of processability problems.

The direction of closing of the cord is obtained by turning the outer layer filaments in the same direction as the direction of the previous twisting of the steel cord.

In order to obtain a torsion balance in the steel cord some or all of the filaments other than the outer filaments have residual torsions which tend to open the steel cord.

A second way to exert a force which is directed radially inward is to preform the outer layer filaments so that they have a preforming ratio, as defined hereinafter, which is smaller than or equal to one hundred percent.

The "preforming ratio" of a particular filament is herein defined as follows:

$$\frac{\text{diameter of the helicoid of the disentangled filament}}{\text{diameter of the helicoid of the filament in the cord}} \times 100$$

In order to avoid the sleeving of the cord, the preforming ratio of the outer layer filaments is kept as low as possible. The preforming ratio of the outer layer filaments, however, must have a lower limit in order to avoid flare, i.e. the spreading of the filament ends after cutting of the cord.

A third way to exert a force which is directed radially inward is to put the outer layer filaments in the steel cord under a tensile force.

The outer layer filaments are put under a tensile force in the steel cord, if after careful disentangling of the outer filaments, the twist pitch of the disentangled outer filaments is smaller than the twist pitch of the steel cord.

In order to obtain a tension balance in the steel cord, some or all of the filaments other than the outer layer filaments are put under a compressive force in the steel cord.

Preferably, at least part of the surface of the filaments is provided with a lubricant in order to obtain a steel cord which slides more easily through narrow openings and which is less prone to sleeving. The lubricant must be of a kind that does not harm the adhesion to the elastomer, and preferably, of a kind that will promote the adhesion of the steel cord to the elastomer.

In order to facilitate further the processability of the steel cord, the steel cord as a whole is preferably free of residual torsions and has no flare.

In a first embodiment of the present invention, the steel cord has a center structure of only one (outer) layer.

In one example of this first embodiment, the layer structure consists of three center filaments and the outer layer consists of nine layer filaments.

In another example the center structure consists of only one center filament and the outer layer consists of six layer filaments.

In both of these examples the diameter of the center filament may be greater that the diameter of the layer filaments. Diameter differences of 0.02 to 0.10 mm, e.g. of 0.02 to 0.06 mm, are common.

In a second embodiment of the present invention, the steel cord has a center structure, an intermediate layer and an outer layer. In one example of this second embodiment, the center structure consists of one center filament, the intermediate layer of six intermediate layer filaments and the outer layer of twelve outer layer filaments.

In another example, the center structure consists of three center filaments, the intermediate layer of nine intermediate layer filaments and the outer layer of fifteen outer layer filaments. In both examples the diameter of the center filaments may be larger than the diameter of the intermediate and outer layer filaments. Diameter differences of 0.02 to 0.10 mm are common.

The part load elongation of any of the center filaments is preferably smaller that the part load elongation of any of the outer layer filaments.

The term "part load elongation" is herein defined as the increase in length of a gauge length at a tension of between 0 to 2.5 Newton and of another predetermined tension between 20 and 50 Newton. The part load elongation of an individual steel filament is measured on the individual steel filament after twisting of the steel cord and after careful—i.e. without plastically deforming—disentangling of the steel filament from out of the steel cord.

In the case of the second embodiment, the part load elongation of any of the intermediate layer filaments is preferably smaller than the part load elongation of any of the outer layer filaments.

With respect to the part load elongation of the outer layer filaments, two subembodiments are possible:

(1) the part load elongation of any of the outer layer filaments is within a narrow range; OR (2) the part load elongation of any of those outer layer filaments that contact two intermediate layer filaments is smaller than the part load elongation of any of those outer layer filaments that contact only one intermediate layer filament.

BRIEF DESCRIPTION OF THE DRAWINGS

The invention will now be described in more detail with reference to the accompanying drawings wherein FIG. 1 schematically illustrates the phenomenon of sleeving;

FIG. 2(*a*) illustrates a cross section of a cord according to a first embodiment of the present invention;

FIG. 2(*b*) illustrates an outer layer filament taken out of a cord according to a first embodiment of the present invention;

FIG. 3(*b*) illustrates an outer layer filament taken out of a cord according to a second embodiment of the present invention;

FIG. 3(*c*) illustrates an intermediate filament taken out of a cord according to a second embodiment of the present invention;

DETAILED DESCRIPTION OF PREFERRED EMBODIMENTS OF THE INVENTION

Figures 3, 3A, 3B:
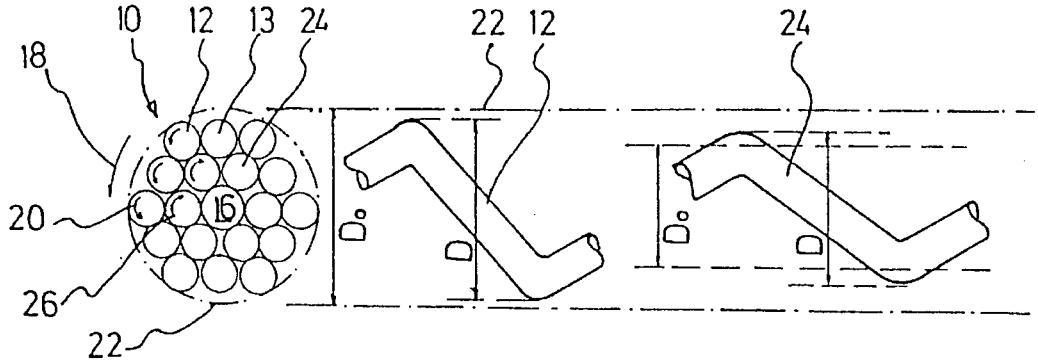
FIG. 3(*a*) illustrates a cross-section of a cord according to a second embodiment of the present invention.

FIG. 1 schematically illustrates the phenomenon of sleeving. The steel cord 10 is drawn through a small opening, and loses its compactness, i.e. the center filaments no longer contact intermediate layer filaments and/or the intermediate layer filaments no longer contact outer layer filaments. This is to be avoided in the case of compact cords, especially if these compact cords are to lie very close to one another in an elastomeric ply of a radial tire, particularly in a carcass ply or particularly in the case of the process of embedding the compact cords in an elastomeric ply in an extrusion process.

In the context of the present invention, a compact steel cord is considered to be a non-sleeving steel cord if it remains a compact cord, i.e. with the outer layer filaments 12 contacting radially the inner filaments, after pulling a length of six meters of a steel cord 10, with both ends burnt (in order to avoid lengthwise shifting of the individual filaments with respect to one another), through a die 14 which has an opening equal to the diameter of the steel cord 10. The sleeving phenomenon has a cumulative effect: if sleeving occurs, the diameter of the steel cord 10 before the die 14 gradually increases over the length of the steel cord and forms a so-called "blister". Should a change in filament position occur within the length of the steel cord, sleeving is stopped temporarily when the change in filament position passes through the die, i.e. the blister disappears. A cord which is prone to sleeving, however, starts again forming a blister after the change in filament position has passed through the die.

FIG. 2(*a*) shows the cross-section of a first embodiment of the present invention, i.e. a steel cord 10 with a center structure of three center filaments 16 and only one (outer) layer with nine outer layer filaments 12, 13.

An example of such a cord is:

3×0.25/9×0.23

Arrow 18 designates the twisting direction of the steel cord 10 (e.g. in Z-direction). The non-sleeving has been realized by providing the outer layer filaments 12, 13 with residual torsions in the same direction as the twisting direction of the steel cord 10. The direction of these residual torsions is designated by arrow 20.

FIG. 2(*b*) shows another way of realizing a non-sleeving cord. The helicoid of the disentangled outer layer filament 12 has a diameter D which is smaller than the diameter $D_o$ of the helicoid of the outer layer filament 12 in the twisted steel cord 10 (22 designates the virtual cylinder around the twisted steel cord).

In other words the preforming ratio of the outer layer filaments is smaller than 100%.

FIG. 3(*a*) shows the cross-section of a second embodiment of a steel cord 10 according to the present invention. The steel cord 10 has a center consisting of one single center filament 16, an intermediate layer of six intermediate layer filaments 24 and an outer layer of twelve outer layer filaments 12, 13: outer layer filaments 12 which contact only one intermediate layer filament 24 and outer layer filaments 13 which contact two intermediate layer filaments 24.

An example of such a cord is as follows:

1×0.22/6×0.20/12×0.20

The direction of twisting of the steel cord has been designated by arrow 18 (e.g. Z direction). The outer layer filaments have residual torsions in the Z-direction (see arrow 20) which tend to close the steel cord. In order to realize a torsion balance and a steel cord which is as a whole free of residual torsion, the intermediate layer filaments 24 have residual torsions in the S-direction, i.e. residual torsions which tend to open the steel cord.

FIG. 3(*b*) shows another way of realizing a non-sleeving cord: the preforming ratio $(D/D_o)\times 100$ of the outer layer filaments 12, 13 is smaller than 100%.

As illustrated by FIG. 3(*c*), the preforming ratio $(D/D_o)\times 100$ of the intermediate layer filaments 24 can be greater than 100%.

Figure 4:
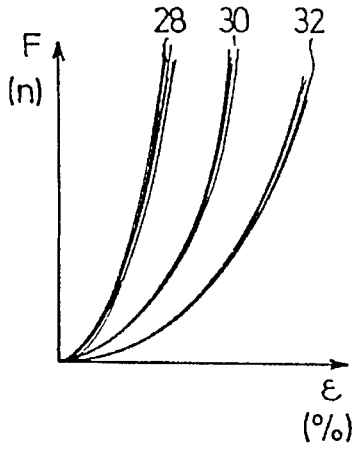
FIGS. 4 and 5 show curves of part load elongation of filaments taken out of a cord according to the second embodiment of the present invention.
Figure 5:
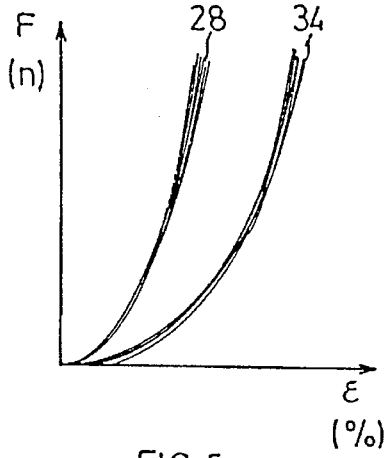

FIGS. 4 and 5 illustrate the part load elongation (PLE) of the individual disentangled steel filaments (not of the whole steel cord) of steel cords according to the present invention. The abscissa is the increase in length or elongation, the Y coordinate is the tension (2.5N–50N) exerted on the individual disentangled steel filaments.

FIG. 4 corresponds to the embodiment where the non-sleeving has been realized by the residual torsions of the outer layer filaments which close the cord. The PLE-values of the intermediate layer filaments 24 are represented by curves 28 which are all within a narrow range. The PLE values of outer layer filaments 13 which contact two intermediate layer filaments 24, are represented by curves 30 which are also within a narrow range. Finally, the PLE-values of outer layer filaments 12 which contact only one intermediate filament 24, are represented by curves 32 which are also within a narrow range.

FIG. 5 corresponds to the embodiment where the non-sleeving has been realized by preforming ratios of the outer filaments which are smaller than 100%. The PLE-values of the intermediate layer filaments 24 are again represented by curves 28 which are all within a narrow range. The PLE-values of all the outer layer filaments 12 and 13 are now within the same narrow range and are represented by curves 34.

Figure 6:
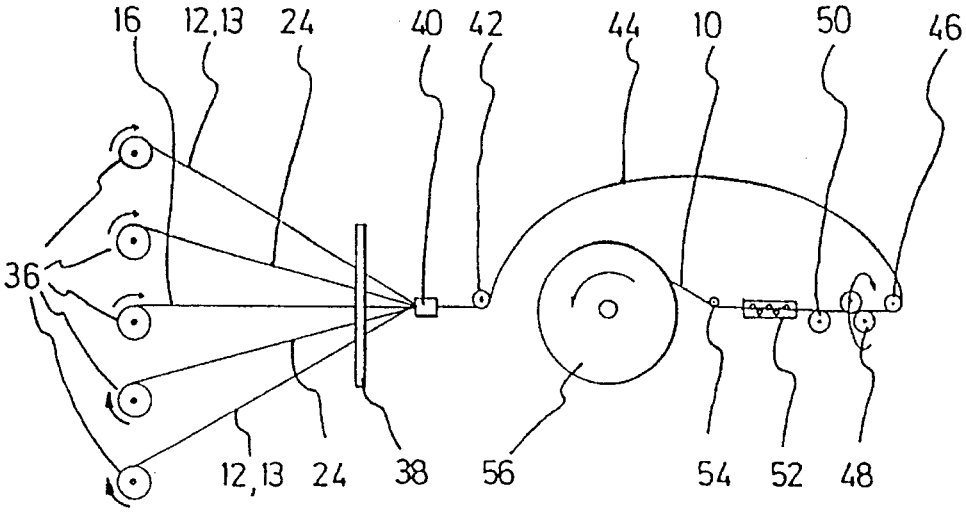
FIG. 6 schematically illustrates the way of manufacturing a steel cord according to the present invention.

A method of manufacturing steel cords according to the present invention is illustrated in FIG. 6. Starting from the left side of FIG. 6, the individual steel filaments 12, 13, 16 and 24 are drawn from the supply spools 36 and guided via a distributing disc 38 to a twisting die 40. A lubricant can be added to the steel filaments as they enter into the twisting die 40. The filaments are directed to a guiding pulley 42 where they receive a first twist for each rotation of flyer 44. The (partially) twisted cord is guided over flyer 44 to a reversing pulley 46 where the cord receives a second twist for each rotation of flyer 44. The twisted cord 10 is subsequently led to a rotating false twister 48 which, as is generally known in the art, can free the whole steel cord of residual torsion. A capstan 50 draws the steel cord through all the upstream steps. The steel cord is further led to a straightener 52 and wound over a guiding pulley 54 on spool 56.

The embodiment of the outer layer filaments 12, 13 having residual torsions which tend to close the steel cord 10 can be realized by giving the outer layer filaments 12, 13 torsions which are opposite in direction to and smaller in number than the torsions given to the outer layer filaments and to the steel cord during the twisting process. Tuning of the revolution speed of the false twister 48 can free the whole steel cord 10 of residual torsion, while the outer layer filaments 12, 13 tend to close the steel cord 10 and the intermediate layer filaments 24 tend to open the steel cord 10.

The embodiment of the outer layer filaments 12, 13 having a preforming ratio smaller than 100% can be realized by correct location of the guiding holes for the outer layer filaments in the distributing disc 38 and by suitably arranging the distance between the distributing disc 38 and the twisting die 40. The greater the angle formed by the outer layer filaments 12, 13 and the center filament 16 when approaching the twisting die 40, the greater the preforming degree.

The embodiment where the outer layer filaments are under a tensile force in the cord can be realized by drawing a length for the outer layer filaments 12, 13 from the supply spools 36 which is slightly insufficient and thus smaller than the length really needed in the final twisted cord. This can be obtained by preventing the twists given to the cord and the filaments from travelling upstream from reversing pulley 46 to guiding pulley 42.

We claim:

1. A steel cord comprising:

a center structure of one to five center filaments; and an outer layer of outer layer filaments surrounding said center structure;

wherein all the center filaments and all the outer layer filaments have the same twist direction and have the same twist pitch;

wherein the steel cord is free of a wrapping filament; that being, the steel cord consists essentially of filaments that have the same twist direction and the same twist pitch; and wherein the outer layer filaments have a preforming ratio which is smaller than one hundred percent so that the outer layer filaments exert a force which is directed radially inward, and which is of such a magnitude that sleeving of the steel cord is prevented.

2. A steel cord according to claim 1 wherein at least part of the surface of the filaments has been provided with a lubricant.

3. A steel cord according to claim 1 wherein the steel cord has only one layer of outer layer filaments.

4. A steel cord according to claim 3 wherein the center structure consists of three center filaments.

5. A steel cord according to claim 3 wherein the outer layer consists of nine layer filaments.

6. A steel cord according to claim 3 wherein the center structure consists of one center filament.

7. A steel cord according to claim 3 wherein the outer layer consists of six layer filaments.

8. A steel cord according to claim 3 wherein all the center filaments have the same diameter, all the layer filaments have the same diameter and wherein the diameter of the center filaments is greater than the diameter of the outer layer filaments.

9. A steel cord according to claim 1, wherein the steel cord further comprises an intermediate layer of intermediate layer filaments between the center structure and the outer layer, the intermediate layer filaments have the same twist directions and same twist pitch as the center filaments and the outer filaments.

10. A steel cord according to claim 9, wherein all the center filaments have the same diameter, all the intermediate layer filaments have the same diameter, and all the outer layer filaments have same diameter; and wherein the diameter of the center filaments is greater than the diameter of the intermediate layer filaments.

11. A steel cord according to claim 9 wherein the number of center filaments is one, the number of intermediate layer filaments is six and the number of outer layer filaments is twelve.

12. A steel cord according to any of claim 9 wherein the number of center filaments is three, the number of intermediate layer filaments is nine and the number of outer layer filaments is fifteen.

13. A steel cord according to claim 9 wherein the intermediate layer filaments have preforming ratio greater than 100% which tend to open the steel cord.

14. A steel cord according to claim 9 wherein the part load elongation of any of the intermediate layer filaments is smaller than the part load elongation of any of the outer layer filaments.

15. A steel cord according to claim 9 wherein the part load elongation of any of the outer layer filaments that contact two intermediate layer filaments is smaller than the part load elongation of any of the outer layer filaments that contact only one intermediate layer filament.

16. A steel cord according to claim 1 wherein the center filaments have residual torsions which tend to open the steel cord.

17. A steel cord according to claim 1 wherein the part load elongation of any of the center filaments is smaller than the part load elongation of any of the outer layer filaments.

18. A steel cord according to claim 1 wherein the steel cord as a whole is free of residual torsion.

19. A steel cord according to claim 1 wherein the steel cord has an unravelled length of zero millimeters at a cut end.

20. A steel cord according to claim 1, wherein all of said center filaments and said outer layer filaments have a diameter ranging from 0.05 to 0.80 mm and are coated with an elastomer adherable layer.

21. A steel cord consisting essentially of:

a center structure of one to five center filaments; and an outer layer of outer layer filaments surrounding said center structure;

wherein all the center filaments and all the outer layer filaments have the same twist direction and have the same twist pitch; and wherein the outer layer filaments have a preforming ratio which is smaller than one hundred percent so that the outer layer filaments exert a force which is directed radially inward, and which is of such a magnitude that sleeving of the steel cord is prevented.

* * * * *